US008887350B2

(12) United States Patent
Miles

(10) Patent No.: US 8,887,350 B2
(45) Date of Patent: Nov. 18, 2014

(54) DUAL PURPOSE VACUUM CLEANER FOR USE ON BOTH, FLOORS AND STAIRS

(75) Inventor: Alexander Gareth Miles, Caerwent (GB)

(73) Assignee: Siddons Furniture Limited, Pembrokeshire (GB)

( * ) Notice: Subject to any disclaimer, the term of this patent is extended or adjusted under 35 U.S.C. 154(b) by 67 days.

(21) Appl. No.: 13/813,057

(22) PCT Filed: Jun. 8, 2011

(86) PCT No.: PCT/GB2011/000861

§ 371 (c)(1),
(2), (4) Date: Jan. 29, 2013

(87) PCT Pub. No.: WO2012/013915

PCT Pub. Date: Feb. 2, 2012

(65) Prior Publication Data

US 2013/0125338 A1 May 23, 2013

(30) Foreign Application Priority Data

Jul. 30, 2010 (GB) ..... 1012793.4

(51) Int. Cl.
*A47L 5/36* (2006.01)
*A47L 9/00* (2006.01)

(52) U.S. Cl.
CPC .. *A47L 9/00* (2013.01); *A47L 5/367* (2013.01); *A47L 5/36* (2013.01); *A47L 9/009* (2013.01)
USPC ..... 15/327.2; 15/339

(58) Field of Classification Search
CPC ..... A47L 5/36; A47L 5/367
USPC ..... 15/327.1, 327.2, 327.7, 339
IPC ..... A47L 9/00,5/36
See application file for complete search history.

(56) References Cited

U.S. PATENT DOCUMENTS

| | | | |
|---|---|---|---|
| 5,720,076 | A | 2/1998 | Clark |
| 5,755,007 | A | 5/1998 | Dyson |
| 5,937,477 | A | 8/1999 | Dyson |
| 2003/0121120 | A1 | 7/2003 | Ji |
| 2005/0015917 | A1 | 1/2005 | Mattingly et al. |

FOREIGN PATENT DOCUMENTS

| | | |
|---|---|---|
| DE | 93 02 645.5 | 4/1993 |
| GB | 984065 | 2/1965 |
| GB | 2 292 881 A | 3/1996 |
| GB | 2 297 243 A | 7/1996 |

OTHER PUBLICATIONS

UK Search Report in priority application GB 1012793.4, Aug. 16, 2010.
International Search Report from International Application No. PCT/GB2011/00861, mailed Jul. 11, 2011.

*Primary Examiner* — David Redding
(74) *Attorney, Agent, or Firm* — Lempia Summerfield Katz LLC

(57) ABSTRACT

The Vacuum Cleaner is designed with a unique shape which allows it to be placed in a stable position on a flight of stairs and which overcomes the problem of instability when positioned on stairs but also remains suitable for use on a flat surface such as a floor. This shape also enables easy upward movement on stairs and overcomes the problem of maneuverability. The Vacuum Cleaner has one or more rotating ground engaging members which can be locked to allow rotation in a forward direction only, which overcomes the problem that previous Vacuum Cleaners have of being insecure when positioned on stairs and it may have one or more rotating members which can engage with a stair riser to allow traversing in an upward direction with very little hindrance.

10 Claims, 5 Drawing Sheets

DUAL PURPOSE VACUUM CLEANER FOR USE ON BOTH, FLOORS AND STAIRS

RELATED APPLICATION DATA

This U.S. national phase application is based on international application no. PCT/GB2011/000861, filed on Jun. 8, 2011, which claimed priority to British national patent application no. 1012793.4, filed on Jul. 30, 2010. Priority benefit of these earlier filed applications is hereby claimed.

BACKGROUND

1. Field of the Disclosure

This invention relates to a Vacuum Cleaner particularly, to a cylinder-type vacuum cleaner which is designed for stable, safe and easy use on both a flight of stairs and also on a flat surface such as a floor.

2. Description of the Related Art

There are very few prior art machines which have been designed for use on stairs. Those that have, embody awkward and cumbersome mechanisms which protrude to engage with the stairs or body parts which engage with the stair step and depend on the body of the vacuum cleaner being precisely positioned at a particular angle so as to allow the body of the vacuum cleaner to engage with the stairs in order to prevent the Vacuum Cleaner from slipping back down the stair case.

None of these prior art vacuum cleaners are designed or intended to be moved up or down a flight of stairs other than by the user lifting the entire vacuum cleaner and repositioning it on another part of the flight of stairs. This results in a cumbersome manoeuvre. It would be far more convenient if the vacuum cleaner could be pulled up the flight of stairs in a smooth continuous movement by dragging or sliding the body of the vacuum cleaner. The configuration of prior art vacuum cleaners is such that dragging or sliding the machine is difficult and awkward. No Prior art machines are designed in such a way so as to span across two or more stair-treads in order to provide increased stability and also facilitate smooth ascent of the stair case.

Further to this, no prior art machines which are intended to overcome the problems associated with use on a stair case, are configured so that the centre of gravity of the machine creates its' own inherent stability or have a curved undercarriage which is specifically designed to aid movement of the vacuum cleaner up a flight of stairs and yet still allow conventional use of the machine on a flat surface such as a floor. Nor do any prior art machines implement rotating ground engaging members that can be engaged or disengaged to allow movement in one direction only, in order to act as a break against slipping downstairs. No prior art machines which are intended to overcome the problems associated with use on a stair case, are configured so that rotating members incorporated into the front of the vacuum cleaner will allow the nose to ascend a step with very little resistance or have any combination of any of these features which would make them suited for us on a stair case, while retaining the ability to be used on a flat floor.

With Reference to Prior art Machines:

U.S. Pat. No. 5,755,007 refers to a portable cleaning apparatus which attempts to solve some of these issues but does not address the issue of the inability of a machine to smoothly ascend up a stair case by the use of a curved undercarriage. It does not have lockable ground engaging members but rather, relies upon the body of the machine contacting the stair tread in order that friction between the step and the machine body part will act as a break or grip.

U.S. Pat. No. 5,937,477 refers to a portable cleaning apparatus which attempts to solve some of these issues but does not address the issue of the inability of a machine to smoothly ascend up a stair case by the use of a curved undercarriage. It does not have lockable ground engaging members but rather, relies upon the body of the machine contacting the stair tread in order that friction between the step and the machine body part will act as a break or grip. It also does not have the motor of the machine located in such a place that the centre of gravity of the machine aids stability.

U.S. Pat. No. 2003/0121120 A1 refers to a vacuum cleaner which attempts to solve some of these issues but does not address the issue of the inability of a machine to smoothly ascend up a stair case by the use of a curved undercarriage. It does not have lockable ground engaging members but rather, relies upon the body of the machine contacting the stair tread when placed at a particular angle, in order to act as a break or grip.

SUMMARY

The object of this invention is to provide a Vacuum Cleaner which can be used on a floor in the conventional sense and which is also able to be stable, easily used and safely manoeuvred and positioned on a flight of stairs. This object is achieved by means of the shape of the curved undercarriage, which provides stability by traversing two treads and also because of a switchable ratchet mechanism which when disengaged, allows rotation of the ground engaging members in a forward or backward direction to allow easy manoeuvring on floors but when applied, allows the rotating ground engaging members to travel in a forward direction only, for use on stairs and thus overcoming the previous difficulties of using the same vacuum cleaner on both the floor and the stairs.

The curved shape of the undercarriage of this vacuum cleaner allows the smooth movement of the vacuum cleaner over treads as it ascends a stair case. The rotating ground engaging members that engage with the stair tread can be acted upon by the locking mechanism that prevents the vacuum cleaner descending backwards down the stairs and the centre of gravity created by the location of the motor is such that it adds inherent stability when being used on stairs.

The curved shape of the undercarriage of the Vacuum Cleaner facilitates the sliding of the vacuum cleaner up a flight of stairs in a smooth motion by pulling the Vacuum hose or "wand" or by pulling it up by the handle, which means that the ascent of the vacuum cleaner is smoother and easier for the user and that the likelihood of damaging the vacuum cleaner by such action is minimised. The disabling of the rear ground engaging members ability to rotate in a backward or 'downstairs' direction minimises the possibility of the vacuum cleaner slipping down the stair case. The specifically curved shape of the undercarriage of the vacuum cleaner allows it to sit in a very stable position by spanning two, or in the case of large versions more than two, stair treads.

One or more multi-directional, rotating ground engaging members may be located at the front part of the Vacuum Cleaner. The castor is the preferred choice of multi-directional, rotating ground engaging member for this position but should not be regarded as limiting to the present invention. This member allows maximum manoeuvrability and stability of the Vacuum Cleaner when used on a flat surface such as a floor in the conventional sense as well as providing manoeuvrability and stability when used on a stair case or flight of stairs.

In an alternative embodiment, more than one rotating ground engaging members may be used at the front of the vacuum cleaner.

The locking mechanism which is intended to be applied to the rear rotating ground engaging members, is constructed in a manner which allows each rotating ground engaging member to be engaged or disengaged individually by means of the mechanism actuator being built into each individual rotating ground engaging member or alternatively it can be applied to one or more rotating ground engaging members simultaneously by means of the mechanism actuator being built into the body of the Vacuum Cleaner in order to act on either one or more of the rotating ground engaging members or the axle or axles of the rotating ground engaging members.

The handle on the front of the vacuum cleaner may be orientated in a plane which runs from front to back and may also be orientated at alternative angles to that, at the point of manufacture. The handle can also be built into the Vacuum Cleaner in the form of a countersunk grip. These are preferable features but should not be regarded as limiting to the present invention.

One or more rotating members which are not floor engaging members, may be located on the furthest forward point or 'nose' of the front end of the Vacuum Cleaner in order to assist the Vacuum Cleaner to ascend a step with the minimum of resistance.

In an alternative embodiment, one or more rotating members which can engage with a stair case may also be encorporated into the curved undercarriage.

When the vacuum cleaner is to be used on a flat surface such as a floor, the locking mechanism should be disengaged in order to allow free movement in more than one direction, of the vacuum cleaner which can then be manoeuvred or positioned by pulling the suction hose, "wand" or the handle.

When the vacuum cleaner is to be used on a stairs, the locking mechanism should be engaged in order to allow rotation of the ground engaging members, in a forward direction only and thus permitting only forward movement of the vacuum cleaner.

In order to traverse the stair risers, the user pulls the suction hose forward and upwards, until the curved shape of the undercarriage of the vacuum cleaner clears the next step up or until the stair riser engaging member engages with the riser of the stair case in front of the vacuum cleaner and that continues up and onto the next step. The curved shape of the undercarriage of the vacuum cleaner and the provision of the stair riser engaging member, assist in the vacuum cleaner's ascent of the stair tread.

The rotating ground engaging members, having been engaged in a locked position by the actuator, allow only forward movement of the vacuum cleaner and the centre of gravity of the vacuum cleaner specifically aided by the position of the motor, also assists in the rising of the front of the vacuum cleaner to climb the stair tread without resulting in instability or tipping of the vacuum cleaner.

INTRODUCTION TO THE DRAWINGS

The accompanying drawings of the Invention are labelled with the following features where appropriate:

A—Multi Directional Rotating Ground Engaging Member.
B—Curved Undercarriage of the Vacuum Cleaner.
C—Rotating Ground Engaging Member.
D—Locking Ratchet Mechanism Actuator.
E—Motor
F—Vacuum Cleaner
G—Dust Collector
H—Suction Hose
I—Handle
J—Stair Riser Engaging Member The Invention will now be described solely by way of example and with reference to the accompanying drawings:

FIG. 1, shows a sectional view of the Vacuum Cleaner (F) positioned on a flight of stairs and the illustration further represents the position of the motor (E), dust collector (G) and stair riser engaging member (J).

FIG. 2, shows a side view of the Vacuum Cleaner (F) at rest in a stable position on a flight of stairs from a side-on perspective and clearly shows how the curved shape of the undercarriage (B) enables the stable spanning of two steps and how it can assist ascent up a flight of stairs by smoothly transiting over a step. This figure also shows how, the stair riser engaging member (J) will be the first point of contact, should the vacuum cleaner encounter the stair riser that is immediately in front of the vacuum cleaner.

Figure 1:
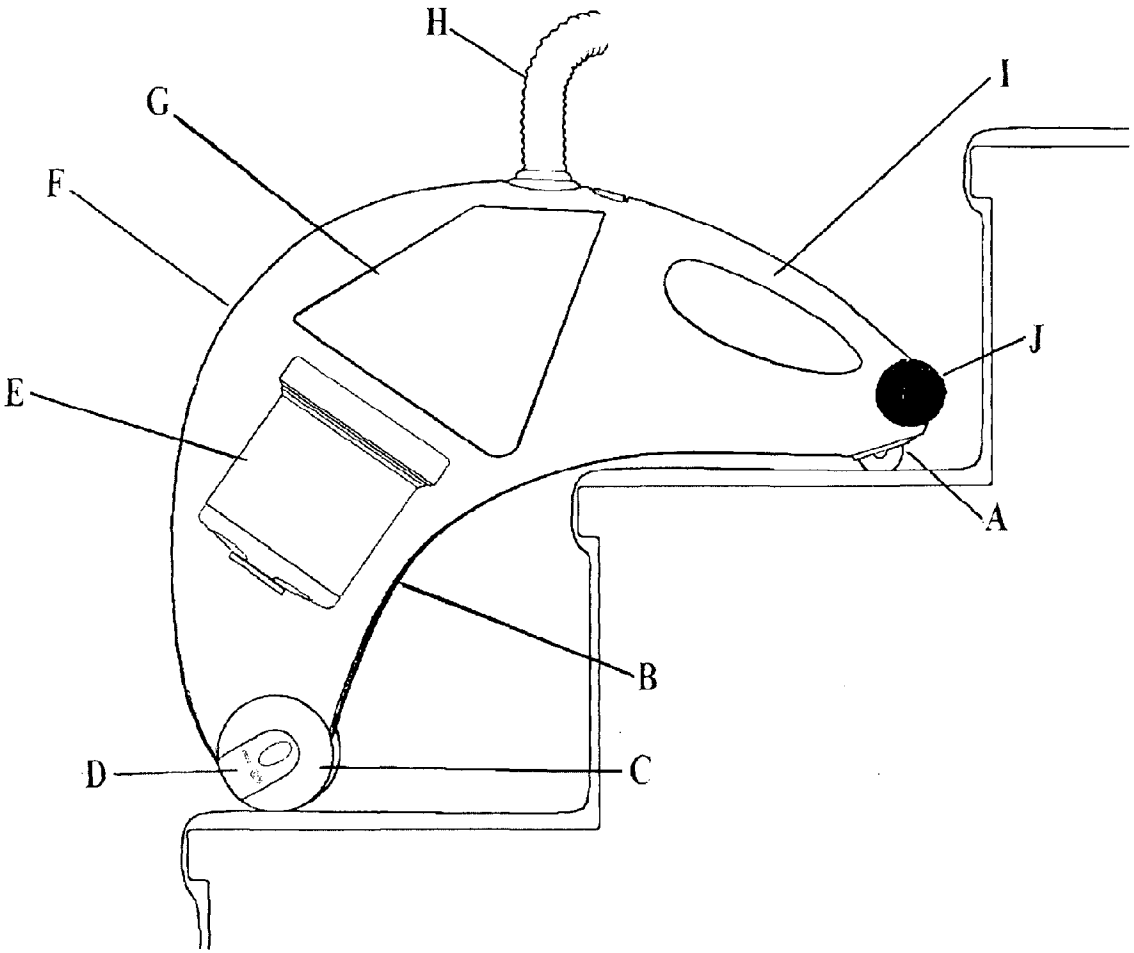
Figure 2:
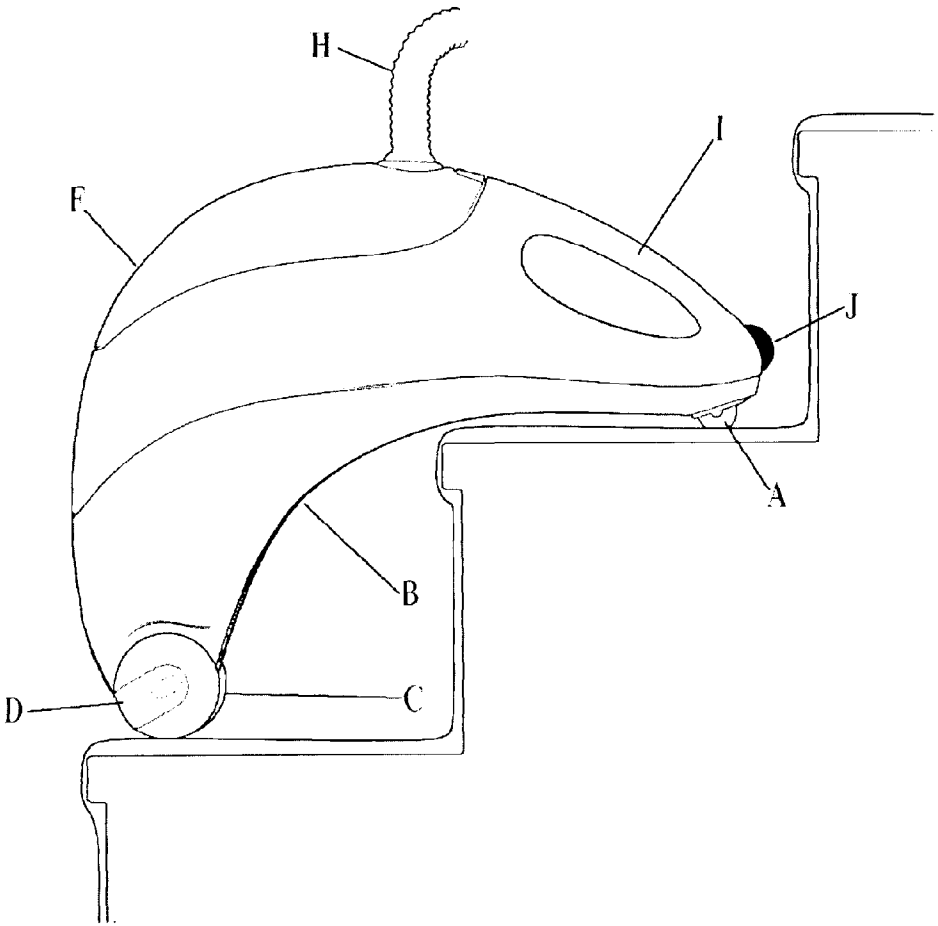
Figure 3:
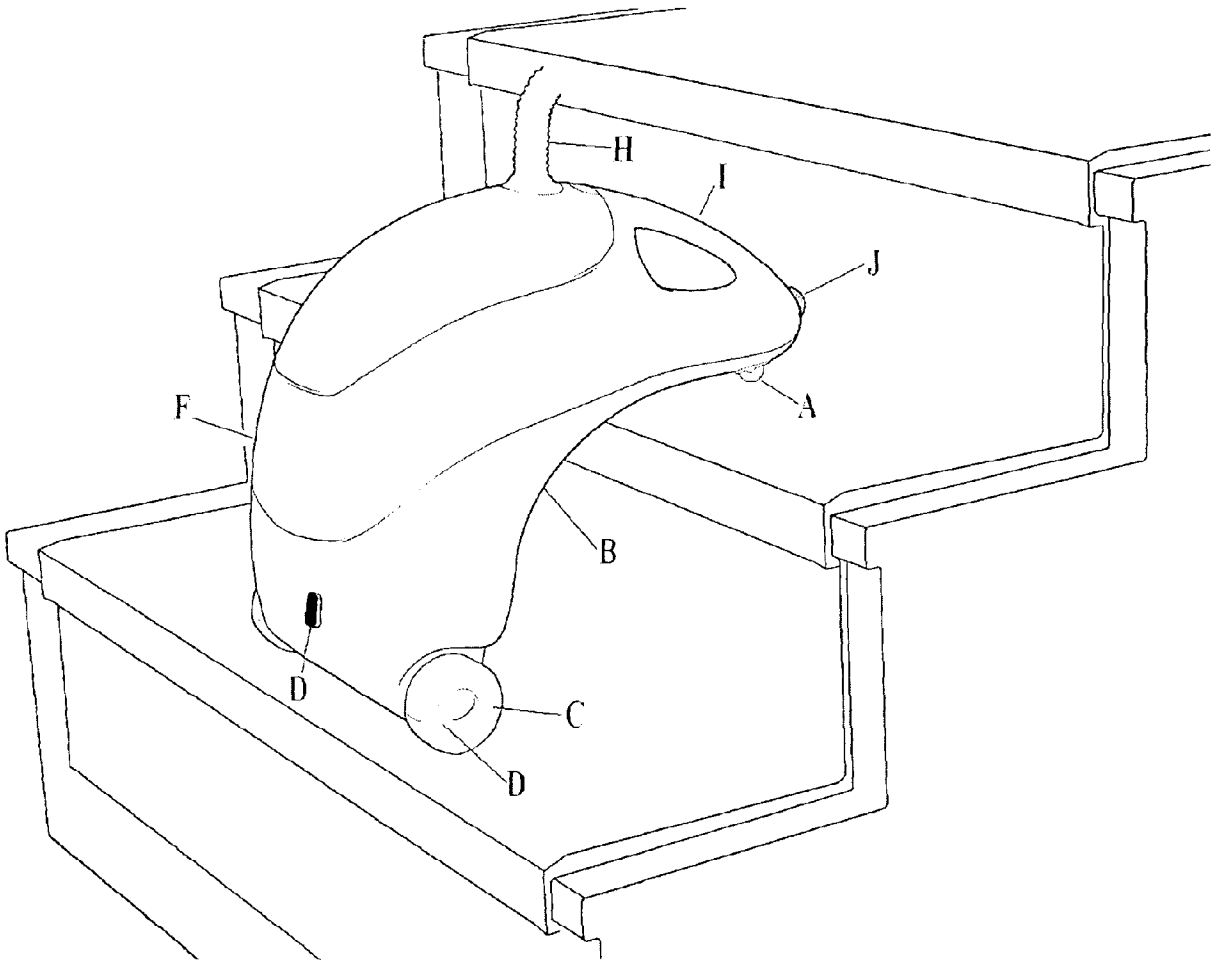
FIG. 3, shows a perspective view of how, when the Vacuum Cleaner (F) is placed onto a stair case, all ground engaging members (A) and (C) are able to engage with the steps to facilitate a stable posture.
Figure 4:
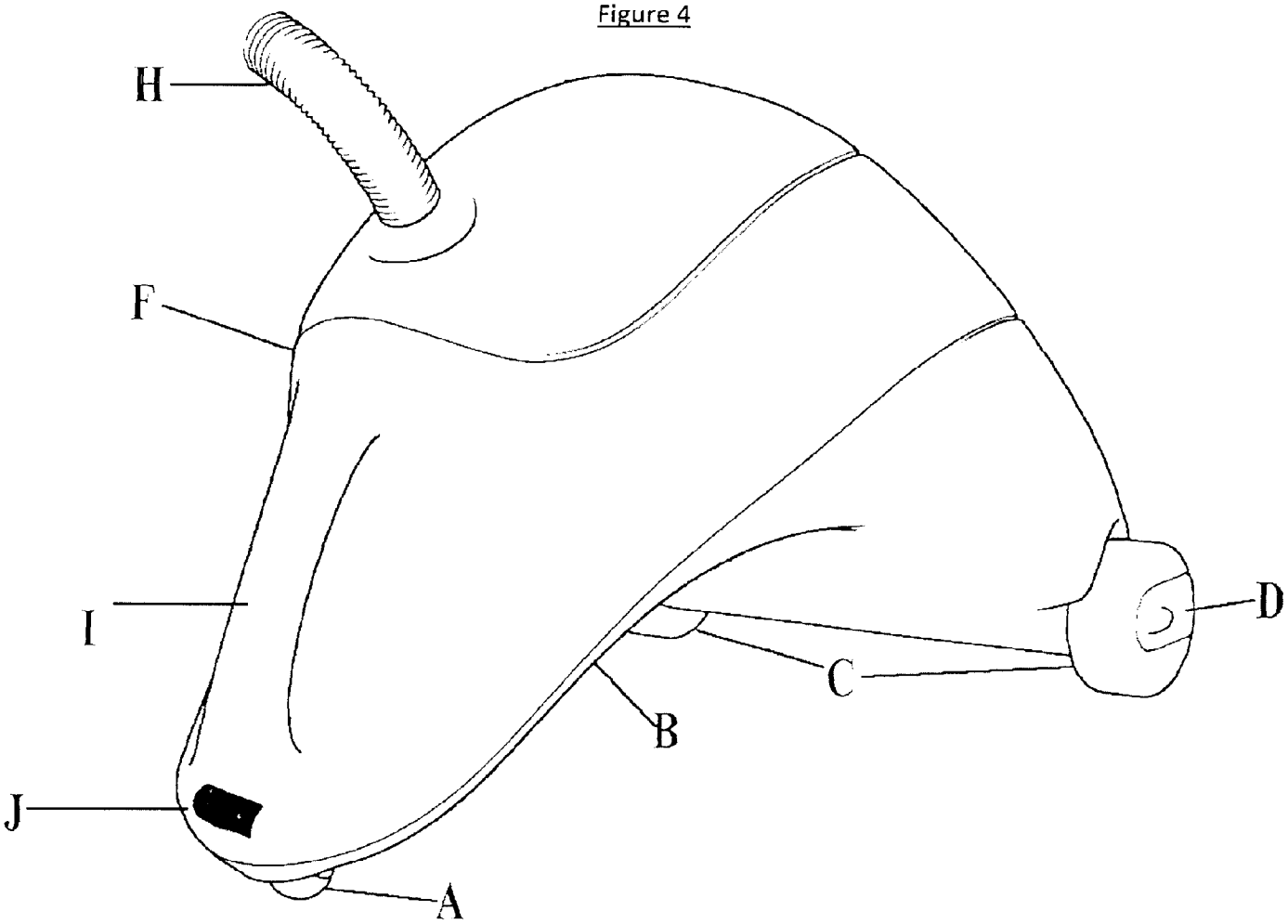
FIG. 4, shows a perspective view of how, when the Vacuum Cleaner (F) is placed onto a flat surface such as a floor, all ground engaging members (A) and (C) are able to engage with the floor to facilitate a stable posture and allow ease of manoeuvrability all directions.
Figure 5:
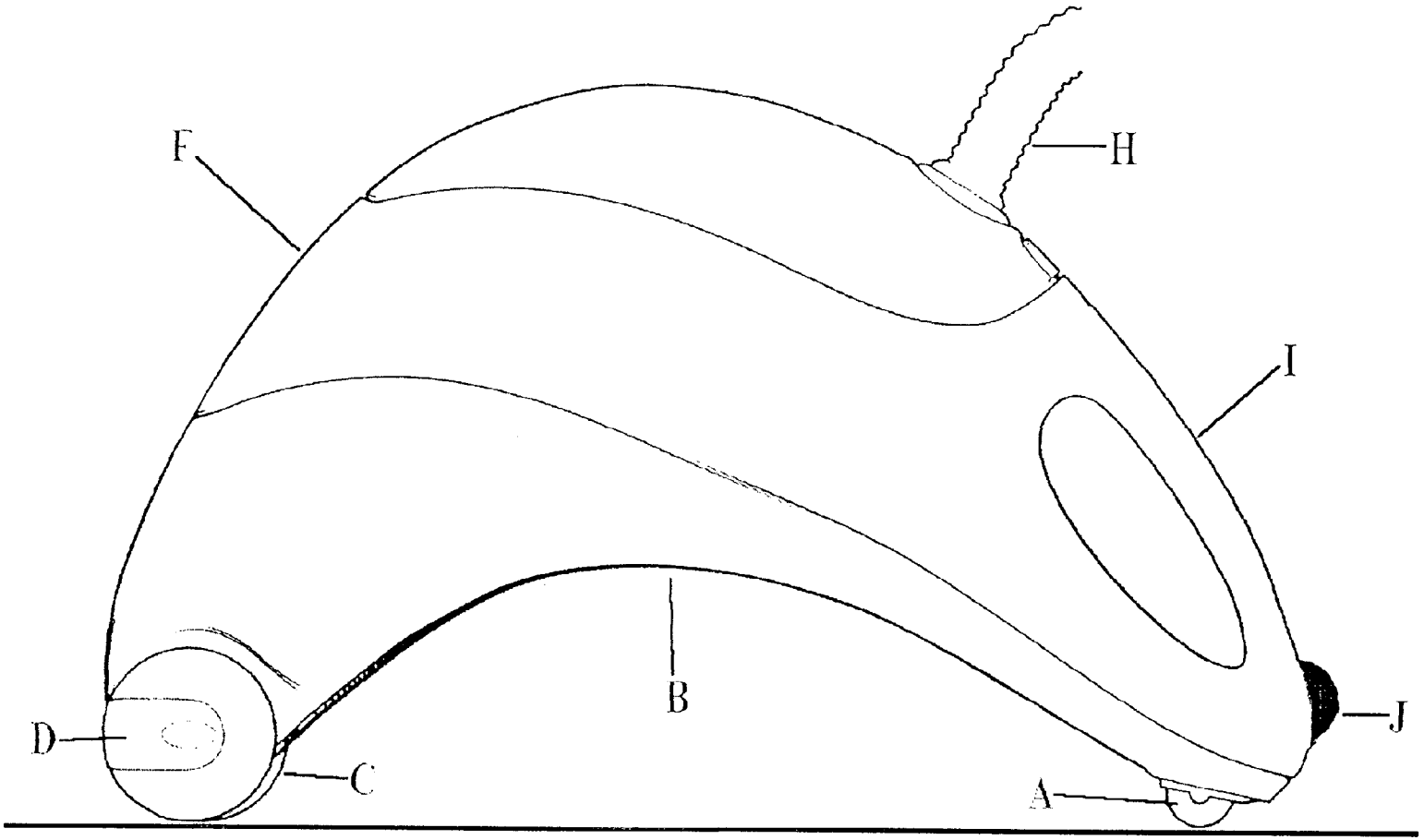
FIG. 5, shows a side view of the Vacuum Cleaner (F) positioned on a flat surface such as a floor.

The Invention will now be described solely by way of example and with reference to the accompanying drawings:

A multi-directional ground engaging member (A) is positioned to provide both a method of support and a means for moving the Vacuum Cleaner (F) which it is able to do so on both stairs or floor.

The curved shape of the undercarriage (B) enables the Vacuum Cleaner (F) to be manoeuvred over stair case risers as it facilitates an easy transition when ascending from one step to another and also allows the multi-directional ground engaging member (A) to be positioned so as to engage with the higher step.

The rear ground engaging members (C), give stability, facilitate a method for moving the Vacuum Cleaner (F) and are also lockable by use of the Locking Ratchet Mechanism Actuator (D) so that the Vacuum Cleaner (F) is unable to roll back and move down the stair case in an uncontrolled manner.

The motor (E) of the Vacuum Cleaner (F) is positioned in such a location as to offer a low centre of gravity which ensures further stability.

The Vacuum Hose (H) is located at a position which also allows it to be used to pull the Vacuum Cleaner (F) upwards when used on a stair case or in multiple directions when used on a flat surface such as a floor.

A handle or grip (I) is located towards the front or 'nose' of the vacuum cleaner (F) for ease of use and manoeuvrability.

A unique stair riser engaging member (J) is incorporated into the front of the Vacuum Cleaner (F) to allow vertical ascent of stair riser with the least possible hindrance.

The invention claimed is:

1. A vacuum cleaner for use on a flat surface such as a floor and also for use on a staircase, the vacuum cleaner comprising:

a body having a curved undercarriage which allows the vacuum cleaner to span two or more steps of a staircase; and a plurality of rotating ground engaging members;

wherein at least one of the ground engaging members can be unlocked to allow rotation in both a forward direction and a backward direction or locked to move in the forward direction only.

2. A vacuum cleaner according to claim 1, wherein one or more of the rotating ground engaging members can be unlocked or locked by a mechanism which is incorporated into one or more of the rotating ground engaging members.

3. A vacuum cleaner according to claim 1, wherein the rotating ground engaging members can be unlocked or locked by a mechanism including an actuator which is incorporated into one or more of the ground engaging members.

4. A vacuum cleaner according to claim 1, wherein one or more of the rotating ground engaging members can be unlocked or locked by a mechanism which is incorporated into the body of the vacuum cleaner.

5. A vacuum cleaner according to claim 1, wherein one or more of the rotating ground engaging members can be unlocked or locked by a mechanism including an actuator which is incorporated into the body of the vacuum cleaner.

6. A vacuum cleaner according to claim 1, wherein the vacuum cleaner has an additional rotating stair riser engaging member at the front most point of the vacuum cleaner to assist in the vacuum cleaner's ascent of stair treads.

7. A vacuum cleaner according to claim 1, wherein at least one of the rotating ground engaging members is located at the front of the vacuum cleaner.

8. A vacuum cleaner for use on a flat surface such as a floor and also for use on a staircase, the vacuum cleaner comprising:

a body having a curved undercarriage which allows the vacuum cleaner to span two or more steps of a staircase; and a plurality of rotating ground engaging members;

wherein the vacuum cleaner comprises a rotating stair riser engaging member at the front of the vacuum cleaner, the rotating stair riser engaging member being positioned to provide the first point of contact when the vacuum cleaner encounters a stair riser that is immediately in front of the vacuum cleaner.

9. A vacuum cleaner according to claim 8, wherein the rotating stair riser engaging member is located at the furthest forward point of a front end of the vacuum cleaner.

10. A vacuum cleaner according to claim 8, wherein the rotating stair riser engaging member is spaced from the plurality of rotating ground engaging members by the curved undercarriage.

* * * * *